United States Patent [19]

Barrett

[11] Patent Number: 4,776,972

[45] **Date of Patent: * Oct. 11, 1988**

[54] ADJUSTABLE STRENGTH LAUNDRY BLEACHING USING A TWO COMPARTMENT PACKAGE

[75] Inventor: John H. Barrett, La Mirada, Calif.

[73] Assignee: Purex Corporation, Phoenix, Ariz.

[ * ] Notice: The portion of the term of this patent subsequent to Oct. 22, 2003 has been disclaimed.

[21] Appl. No.: 834,366

[22] Filed: Feb. 28, 1986

Related U.S. Application Data

[63] Continuation of Ser. No. 596,669, Apr. 4, 1984, abandoned.

[51] Int. Cl.[4] ..... B65D 51/28; B65D 79/00; B65D 81/32; C11D 17/04

[52] U.S. Cl. ..... 252/90; 206/216; 206/219; 206/221; 206/568; 215/6; 215/10; 215/DIG. 8; 220/23; 252/89.1; 252/95; 252/99; 252/186.38

[58] Field of Search ..... 206/216, 219, 220, 221, 206/222, 568; 215/6, 10, DIG. 8; 220/23; 252/90, 95, 99

[56] References Cited

U.S. PATENT DOCUMENTS

| | | | |
|---|---|---|---|
| 1,427,820 | 9/1922 | Kaufman . | |
| 1,466,593 | 8/1923 | Kirchmer | 206/568 |
| 1,657,312 | 1/1928 | McEldowney | 134/30 |
| 1,918,307 | 7/1933 | Webber . | |
| 2,072,630 | 3/1937 | Ferry . | |
| 2,321,998 | 6/1943 | Crouch | 252/157 |
| 2,385,648 | 9/1945 | Prager . | |
| 2,629,508 | 2/1953 | Prager . | |
| 2,766,796 | 10/1956 | Tupper | 150/55 |
| 3,537,898 | 11/1970 | Fidler | 134/22 |
| 3,968,048 | 7/1976 | Bolan | 252/157 |
| 4,003,841 | 1/1977 | Hachmann | 252/94 |
| 4,028,263 | 6/1977 | Gray | 252/99 |
| 4,116,878 | 9/1978 | Deutscher | 252/94 |
| 4,206,068 | 6/1980 | Davis | 252/89.1 |
| 4,235,599 | 11/1980 | Davis | 252/95 |
| 4,269,722 | 5/1981 | Joshi | 252/90 |

FOREIGN PATENT DOCUMENTS

| | | |
|---|---|---|
| 1046877 | 12/1953 | France . |
| 370168 | 4/1932 | United Kingdom . |
| 676072 | 7/1952 | United Kingdom . |
| 771889 | 4/1957 | United Kingdom . |

*Primary Examiner*—Dennis Albrecht
*Attorney, Agent, or Firm*—William W. Haefliger

[57] ABSTRACT

The invention relates to products useful for home laundering, and more particularly to adjustable strength bleaching compositions, highly advantageous packaging of such compositions, and a method of bleaching involving the combination of the two. More specifically, the invention concerns a highly practical and saleable laundry aid which can be used both on sensitive fabrics/dyes as an all-fabric safe oxygen bleach, and on less vulnerable fabrics/dyes as a much more effective hypohalite bleach of potency similar to that of liquid chlorine bleach. The invention is concerned with the use of an alkali metal halide activator with an oxygen bleach which is packaged in a two compartment package to keep the components separate before use.

17 Claims, 8 Drawing Sheets

ADJUSTABLE STRENGTH LAUNDRY BLEACHING USING A TWO COMPARTMENT PACKAGE

This application is a continuation of Ser. No. 596,669, filed Apr. 4, 1984, now abandoned; U.S. Pat. Nos. 4,618,444; 4,563,186; 4,615,814; and 4,606,775 are related.

BACKGROUND OF THE INVENTION

This invention relates generally to products useful for home laundering, and more particularly to adjustable strength bleaching compositions, highly advantageous packaging of such compositions, and a method of bleaching involving the combination of the two. More specifically, the invention concerns a highly practical and saleable laundry aid which can be used both on sensitive fabrics/dyes as an all-fabric safe oxygen bleach, and on less vulnerable fabrics/dyes as a much more effective hypohalite bleach of potency similar to that of liquid chlorine bleach.

Typical laundry wash temperatures in the United States continue to decline for various reasons; and with them, the bleaching ability of the oxygen bleaching agents in conventional all-fabric safe bleaches (e.g. sodium perborate). Such agents remain in wide use despite this fact, because of their efficacy at elevated temperatures, and their virtual inability to harm sensitive fabrics and dyes, regardless of the washing conditions. Chlorine bleaches on the other hand, though very potent even at low temperature, are well known to affect adversely many colored fabrics, and they often substantially reduce the efficacy of many fluorescent whitener agents contained in most detergent products.

The ability of peroxymonosulfate to oxidize halides to hypohalites and hypohalous acids; and to consequently boost the overall bleaching effectiveness, is well know in the industry. See U.S. Pat. No. 3,458,446,; French Pat. No. 1,568,919; German Pat. No. 1,269,992, and U.S. Pat. No. 1,162,754. There is also substantial prior art concerning methods of reducing fabric degradation when using a sodium bromide activated bleach. German Pat. No. 2,525,878 (see also U.S. Pat. No. 4,116,878) issued to Fritz Deutscher in January of 1976 teaches that textile degradation can be minimized by adding urea or acetamide to a sodium bromide activated peroxymonosulfate bleach. U.S. Pat. No. 4,123,376 issued to Frederick W. Gray in October of 1978 teaches that certain (other) N-hydrogen compounds inhibit destruction of dyes and overbleaching of dyed materials when used in a sodium bromide promoted peroxymonosulfate bleach composition. U.S. Pat. No. 4,028,263 issued to Frederick Gray in June of 1977 discloses certain fluorescent whitening agents which are relatively stable in such a system for use in a detergent/bleach composition. Each of these patents refers only to bleaching enhancement from bromide ion addition, with no mention of the synergism and possible toxicity conditions which result from using a combination of chloride and bromide salts.

SUMMARY OF THE INVENTION

The present invention is based in part on the synergistic differential in bleaching performance obtained by using a combination of chloride and bromide ions above the sum of the bleaching performances obtained when each is used alone, and the facilitation of such combination for use in bleach activation, through unique packaging. In further contrast with the prior art, the present invention contemplates formulating the bromide salt as admixtures intimately comingled with the rest of the composition, with no discrete separation to provide for optional activation by the consumer. In addition to the versatility of the bleaching product disclosed herein, the product also has the advantage of being more stable and consequently more practical and saleable. The formulations previously disclosed were characteristically extremely unstable with the addition of water, which could occur either by passive transmission through the walls of the container in humid environments, or by inadvertant direct addition in use.

It is a major object of the present invention to provide a dry bleach having the performance characteristics of either of the above referenced bleach classes (oxygen and chlorine) and in a highly advantageous unitary package form. The latter typically comprises:

(a) a first openable container containing a bleach base that includes an oxygen bleaching agent, (b) a dispensing container containing a bleach activator composition, and forming a fitment, (c) the fitment carried by the first container to be readily detachable at least in part for dispensing the activator composition to controllably activate the bleach at the time of fabric laundering.

Such multiple container integration into one package serves to physically separate the bleach base and activator component, while enhancing stability as well as bleach strength adjustability. Also, storage, handling, use and effectiveness are facilitated.

Another object of this invention is to employ a mixture of bromide and chloride ions in the activator, which provides synergistic performance, lower cost, and a somewhat lower degree of toxicity as compared with bromide salts, alone.

It is a yet further object to provide a single package design such that the activator dispensing container is not only attached to or integral with the bleach base container, but can be detached from or otherwise used separately from the bleach base product container. Such structural incorporation of the activator dispensing container into the bleach base container is referred to herein as a "fitment", the various unusually advantageous forms of which can best be described by reference to the following drawings and descriptions. Dry bleach base containers useful with the fitment can take the form of bottles or folding cartons as will appear.

In its fabric laundering method aspect, the invention basically contemplates the following steps:

(a) providing a first volume of a bleach base that incorporates an oxygen bleaching agent, a portion of which is to be added to fabric laundry wash water, (b) providing a second volume of a bleach activator composition in close transported association with said first volume of bleach base for presentation at the time of laundering, (c) and separating some of said activator composition from said close association with the bleach base volume and applying same to controllably activate the bleach base in said wash water containing said added portion of the bleach base.

These and other objects and advantages of the invention, as well as the details of an illustrative embodiment, will be more fully understood from the following description and drawing, in which:

DRAWING DESCRIPTION

DETAILED DESCRIPTION

Figure 1:
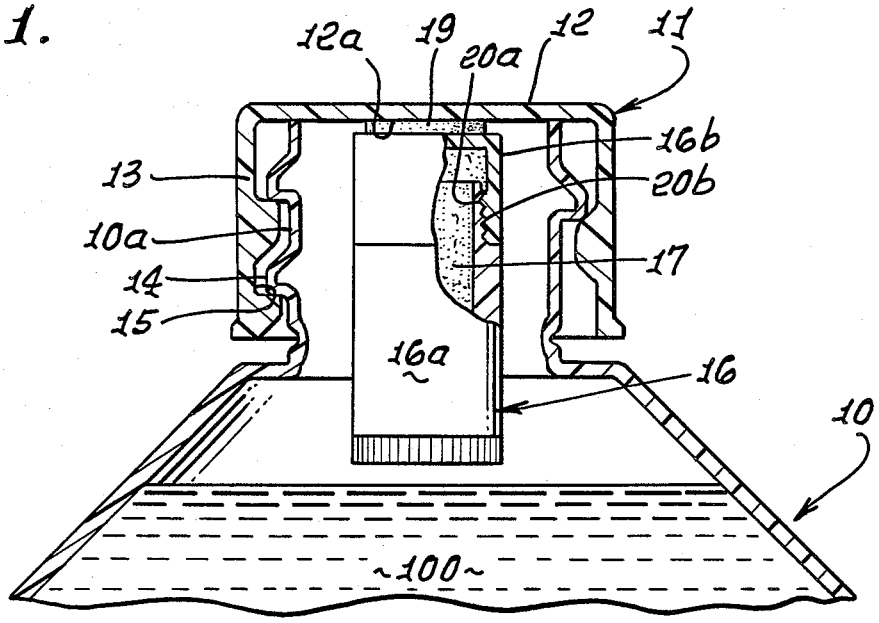
FIG. 1 is a vertical section showing a fitment adhered to the underside of a bottle overcap.

Referring first to the drawings, FIG. 1 illustrates a first container in the form of a bottle 10 having a threaded neck 10*a*, the bottle containing flowable dry bleach base 100 (as for example flowable dry granules). The bottle has a removable cap 11 which in turn has a top horizontal wall 12 overlying the neck 10*a*, and a depending skirt 13 that extends in interfitting section with the neck. As shown, the skirt and neck have interfitting screw threads 14 and 15, other type connections being usable. The bottle, neck and cap may all consist of usable plastic material.

Also provided is a dispensing container as defined by fitment 16 containing a bleach activator composition 17 in flowable granule, tablet or other form. The fitment is indirectly carried by the bottle 10, and directly by the cap 11, to be readily detachable, at least in part, for dispensing the activator composition as at the time of fabric laundering. Thus, for example, removal of the cap 11 to provide access to the dry bleach immediately presents the user with the fitment projecting from the removed cap, reminding the user that the fitment is ready to be used for application of activator composition to wash water receiving the bleach granules, as at the precise time of laundering and in conjunction therewith, to obtain a resulting higher quality adjustable bleaching of the fabric (due to the selection of relative amounts of bleach and activator).

As shown, the fitment has a sub-container 16*a* and a sub-container cap 16*b*, the latter being retained by the top wall 12, and specifically to its underside 12*a* as by means of adhesive, double tape, VELCRO stripping, or other means, each of which is represented by the layer 19. In use, the sub-container 16*a* may be removed from the cap, as by reverse rotation to unscrew threads 20*a* and 20*b*. The activator carried by sub-container 16*a* is then exposed for use, for example, pouring into a measured volume of dry bleach granules to be added to wash water.

The dispensing device itself can be made from plastic, glass, metal or other suitable material for holding a liquid or a solid.

The dry bleach container 10 can be made from any suitable material including polyethylene, polypropylene, PVC and other plastics, glass, metal, or paperboard. In the case of paperboard, a suitable moisture barrier would be advantageous to maintain the product's effectiveness during storage and use.

Figure 2:
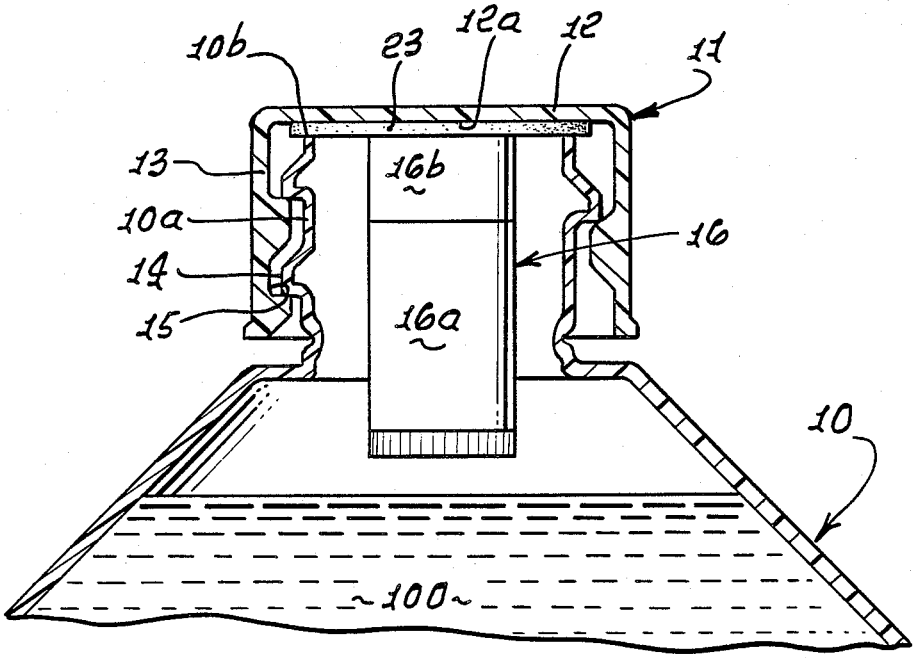
FIG. 2 is a vertical section showing a fitment cap seated on the bottle finish.

In FIG. 2, the elements bearing the same numbers as in FIG. 1 are the same. The fitment cap 16*b* in addition has a radially projecting flange 23 extending over the rim 10*b* of the bottle neck 10*a* and retained on that rim by the underside 12*a* of the bottle cap 11. Thus, the fitment 16 is completely detachable from the cap 11 when the bottle is removed from the neck 10*a*.

Figure 3:
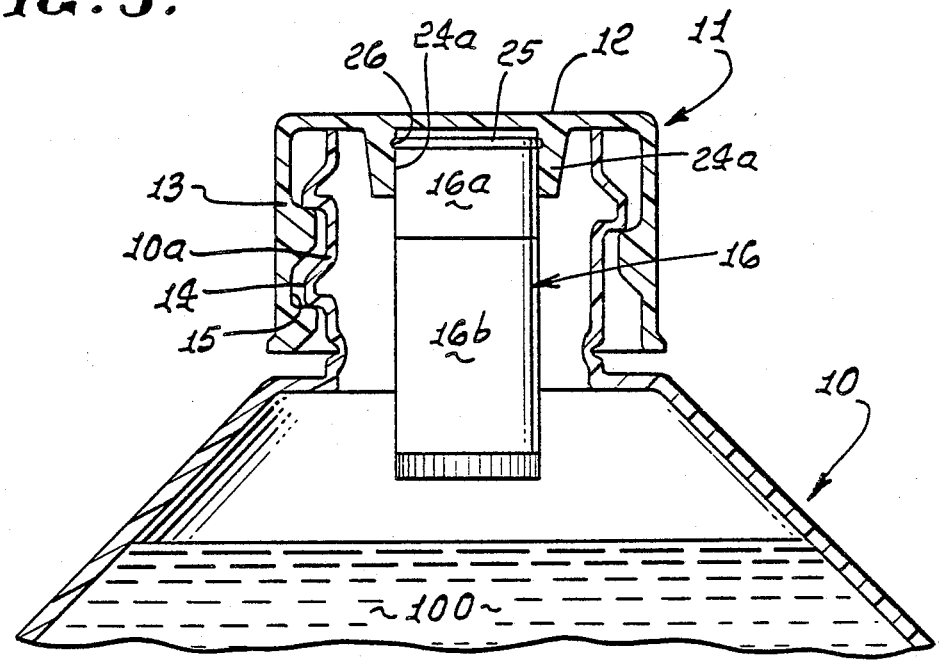
FIG. 3 is a section showing a fitment cap snapped into a friction sleeve in a bottle overcap.

In FIG. 3, the elements bearing the same numbers as in FIG. 1 are the same. The cap top wall 12 in addition has an integral sleeve 24*b* depending therefrom, within the bottle neck. The fitment cap 16*b* may extend telescopically into the sleeve bore 24*a*, and a flange 25 on the cap may removably snap into an annular recess 26 in the bore wall, as shown.

Figure 4:
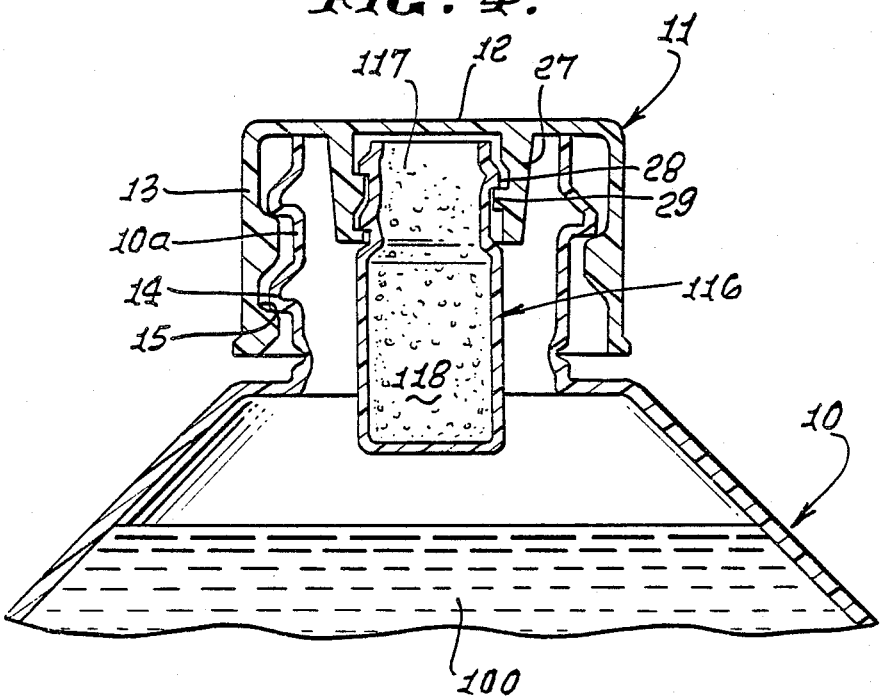
FIG. 4 is a section showing a fitment cap and is similar to FIG. 13.
Figure 13:
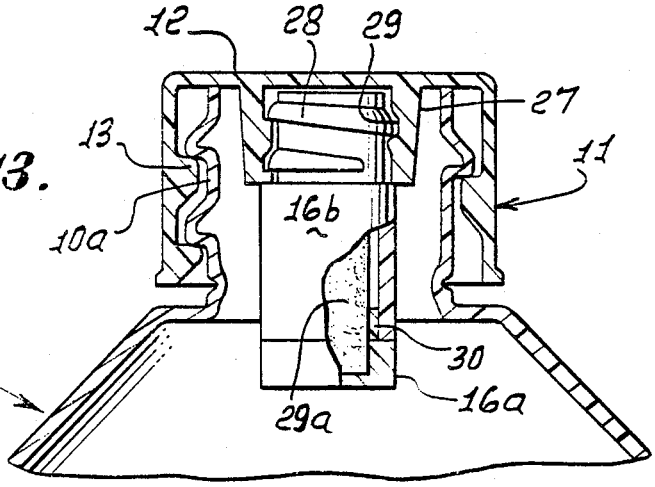
FIG. 13 is a section showing an inverted fitment thread connected into a double threaded overcap.

In FIG. 13, the elements bearing the same numbers as in FIG. 1 are the same. The cap top wall 12 in addition has an integral sleeve 27 depending therefrom, within the bottle neck. The fitment sub-container 16*b* in this embodiment has threaded connection with the sleeve 27, as afforded by threads 28 and 29. The fitment sub-container cap 16*a* is thus presented to the user. He may detach the cap 16*a* and pour activator 29*a* from the sub-container 16*b*. Both cap and sub-container frictionally interfit at 30, other methods of connection being usable. FIG. 4 is like FIG. 13 except the fitment 116 is in one piece and has an open top at 117, directly below wall 12. Fitment thread 28 engages sleeve thread 29. Activator granules in the fitment appear at 118. Activator tablets may be used.

Figure 15:
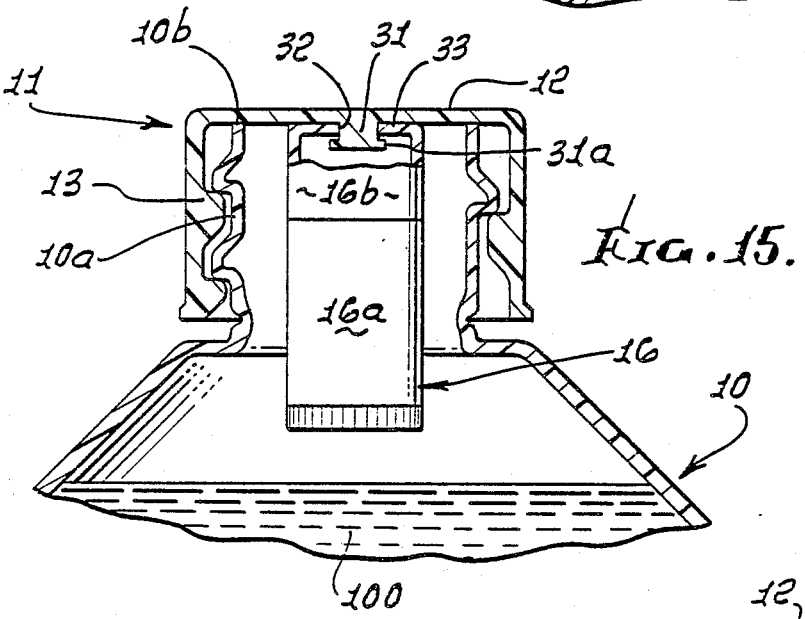
FIG. 15 is a section showing a fitment snap connected onto a plug in the bottle overcap.

In FIG. 15, the elements bearing the same numerals as in FIG. 1 are the same. The fitment cap 16*b* and the bottle cap top wall 12 include removably interfitting snap connection elements, as for example small flanged boss or plug 31 depending from top wall 12 and received through an opening 32 in the fitment cap top wall 33. Opening 32 is slightly smaller in diameter than the flange 31*a*, providing a snap-on interfit. Other forms of snap connection are usable.

Figure 12:
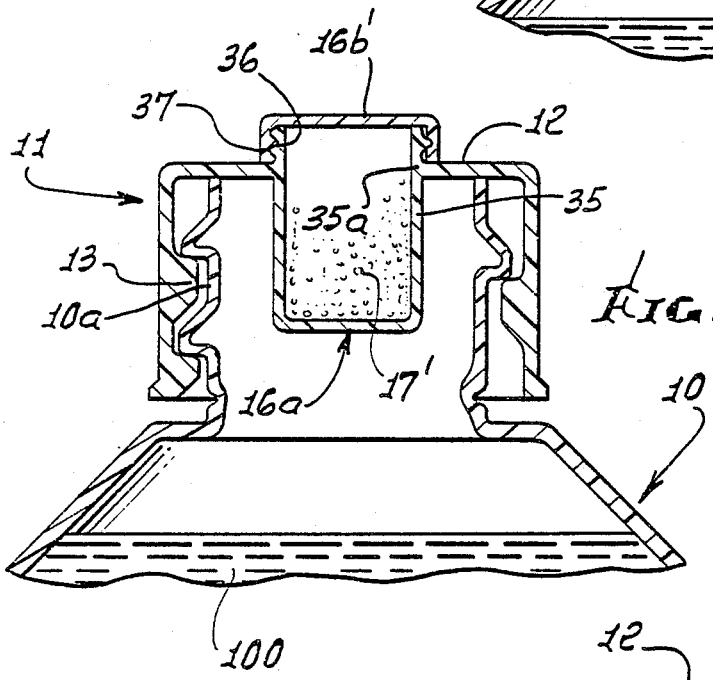
FIG. 12 is a section showing a fitment molded as an integral part of a bottle overcap.

In FIG. 12, the elements bearing the same numerals as in FIG. 1 are the same. The fitment sub-container 16*a* has a side wall 35 integrally molded with the bottle cap top wall 12, at 35*a*, and wall 35 projects and is externally threaded at the upper exterior side of the wall 12. Subcontainer cap 16*b*′ is internally threaded at 36 to engage the external thread 37 on wall 35, as shown. Thus, cap 16*b*′ is easily removable, exteriorly, to allow pouring or other dispensing of the activator 17′ which may consist of flowable granules, or may be in other form.

Figure 11:
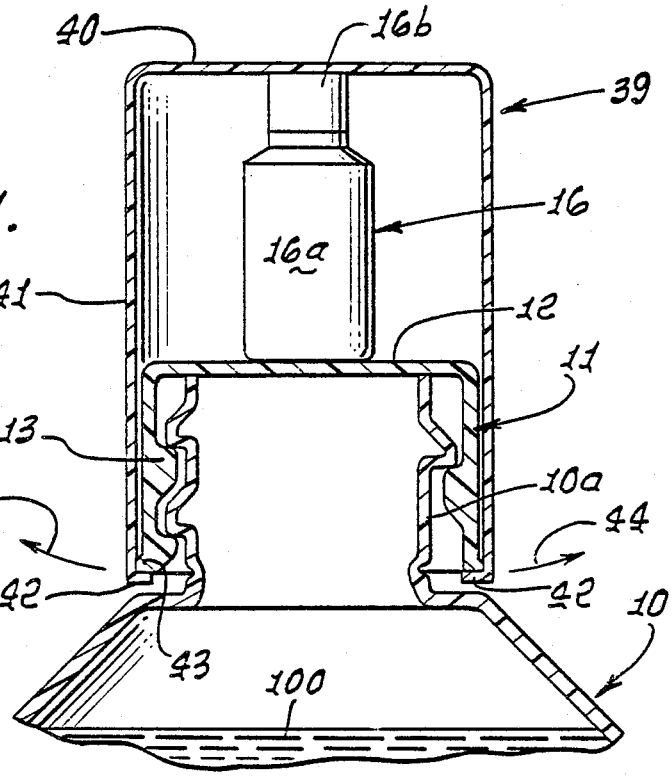
FIG. 11 is a section showing a fitment contained in a bottle snap-on overcap.

In FIG. 11, the fitment 16 is primarily (as for example completely) located outside and above the cap top wall 12, and auxiliary means is provided to retain the fitment in position, just above wall 12. In the example, such auxiliary means has the form of a thin-walled plastic overcap 39, having a top wall 40 located to compressively retain the fitment vertically between walls 40 and 12, as shown. The overcap depending skirt 41 is removably mounted on the bottle cap, so that it may be easily detached. As shown, two lips 42 engage the lower rim 43 of the cap 11, and may be pulled free (see arrows 44) to release the overcap, providing access to the fitment 16.

Figure 14:
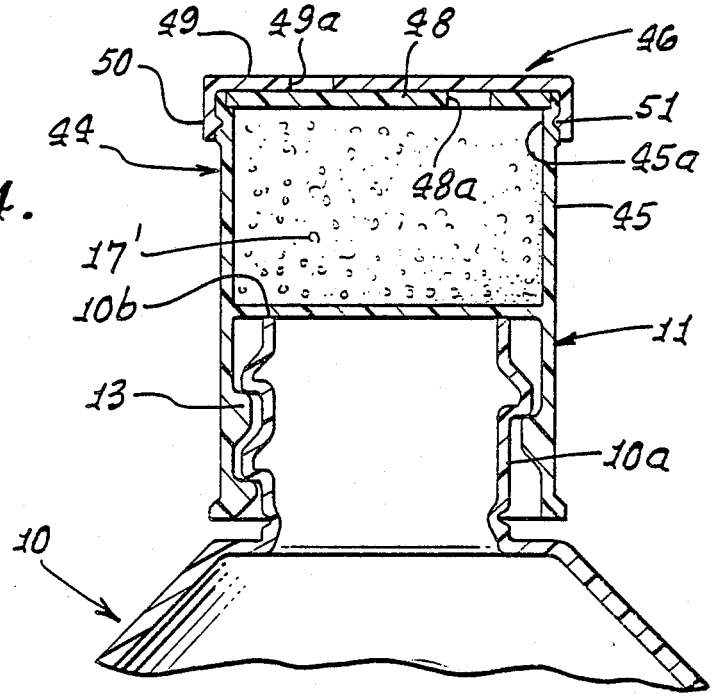
FIG. 14 is a section showing a fitment thread connected over the bottle finish, the fitment having a cap attached to a rotary dispensing closure.

In FIG. 14, the fitment 44 includes a sub-container 45 integral with the bottle cap 11, and extending thereabove. Sub-container cap structure 46 is connected to the sub-container 45, to allow dispensing of the flowable activator composition. As shown, the cap structure includes first and second walls 48 and 49, each containing ports 48*a* and 49*a* normally out of registration. The walls extend adjacent one another, and are relatively rotatable (i.e. wall 49 may rotate relative to wall 48, for example) to bring ports 48*a* and 49*a* into registration, allowing dispensing of activator. Wall 49 is shown as having a skirt 50 with annular detent connection at 51 to the sub-container wall 45*a*, allowing rotation of the skirt and wall 49. Flowable granules are indicated at 17′.

Figure 5:
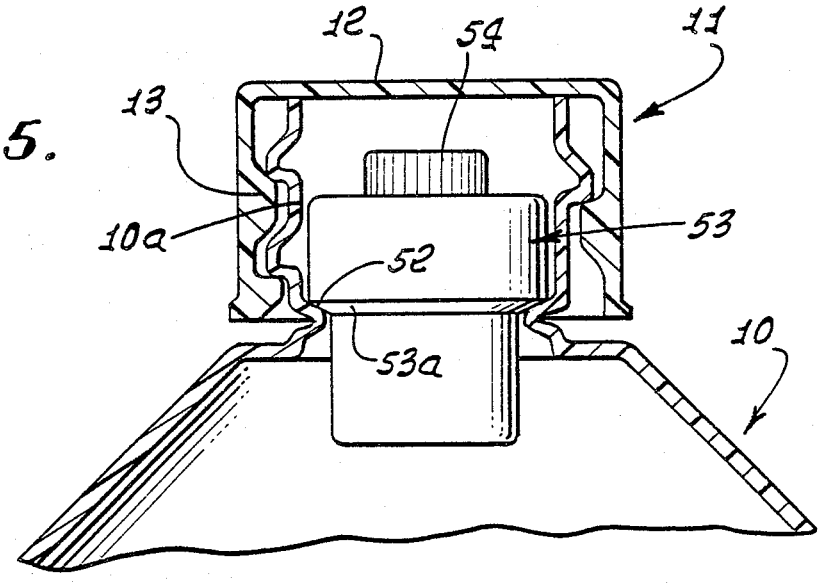
FIG. 5 is a section showing a fitment flange engaging an indent on a bottle neck.
Figure 6:
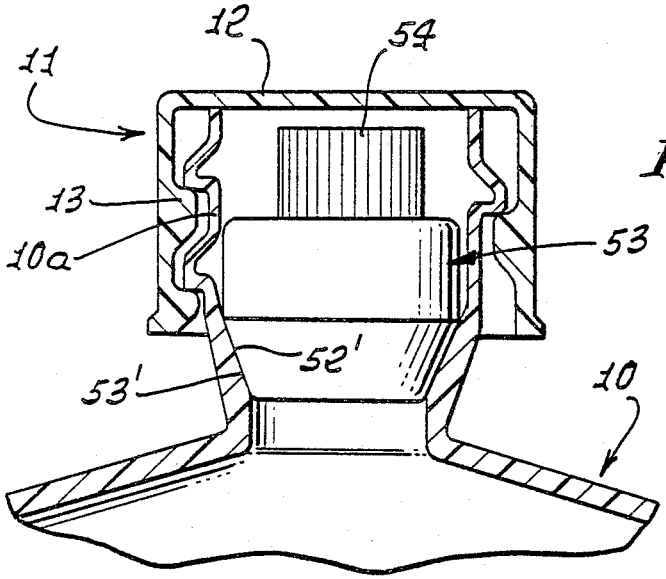
FIG. 6 is a section showing a tapered fitment wedged into a bottle tapered neck.

In FIG. 5, the bottle neck 10*a* has an internal ledge or ledges 52 seating the fitment sub-container 53. The latter has a flanged undersurface 53*a* engaging the ledge, which may be annular. In FIG. 6, the modified ledge 52′ tapers downwardly, and cooperatively engages or seats the frusto-conical outer surface 53′ of the fitment sub-container 53, to position the fitment. Caps for the fitment sub-container appear at 54 in FIGS. 5 and 6, and the fitments are loosely contained within the bottle neck to be completely removable when the bottle cap 11 is removed.

Figure 9:
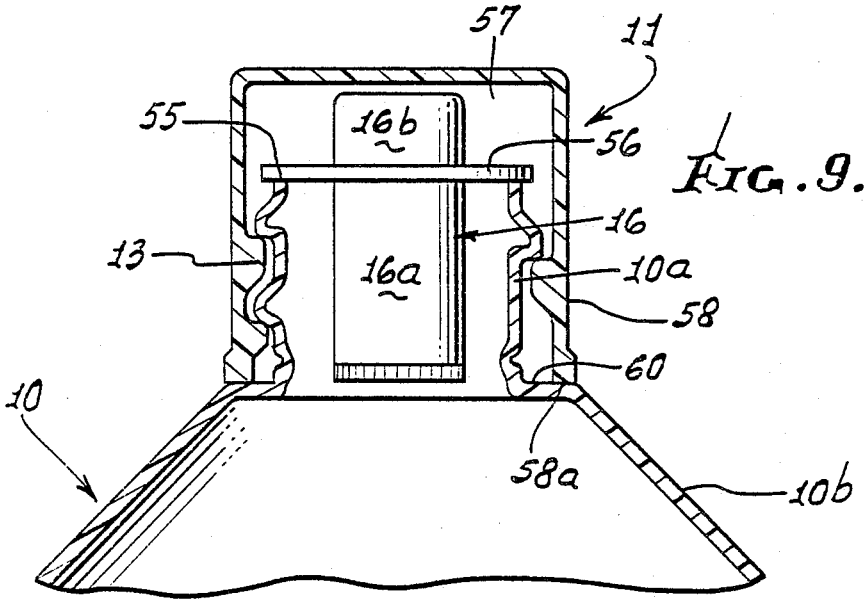
FIG. 9 is a section showing a collar under a fitment cap engaging a bottle sealing surface, and the bottle cap sealing on a bottle shoulder.
Figure 10:
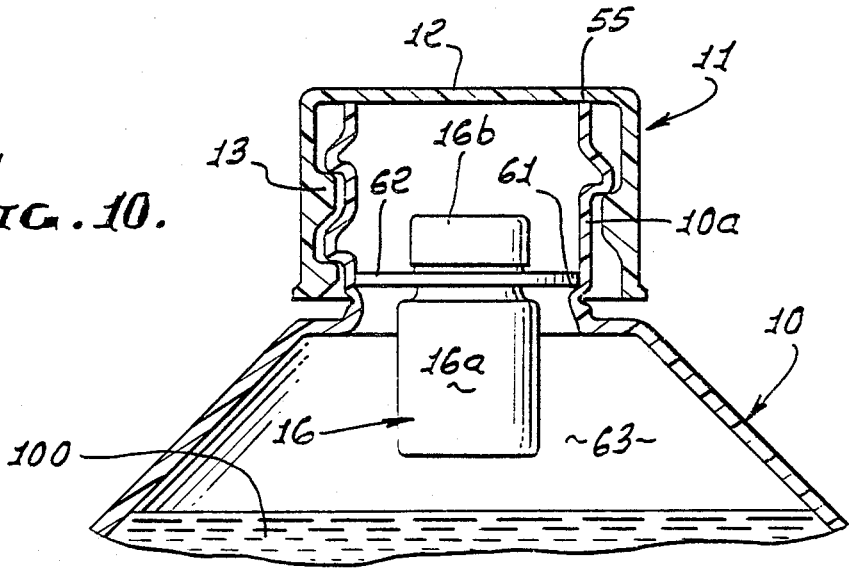
FIG. 10 is a section showing a collar under a fitment cap engaging an indent on a bottle neck.

In FIG. 9, the bottle neck 10*a* has an upper rim 55, and an external flange 56 on the fitment 16 seats on that rim to retain the fitment sub-container 16*a* within the neck 10*a*, and the sub-container cap 16*b* projecting upwardly within the cap upper interior 57. The lower edge or rim 58*a* of the cap skirt 58 seats and seals against the bottle shoulder 60 between neck 10*a* and bottle wall taper 10*b*. In FIG. 10, the bottle neck 10*a* has an internal integral flange or shoulder 61; and an external flange 62 on the fitment 16 seats on that flange 61. The flange is annular, and the fitment sub-container 16*a* projects downwardly through the flange into the bottle upper interior 63. Top wall 12 of cap 11 seats and seals on the upper rim 55 of the neck 10*a*.

Figure 8:
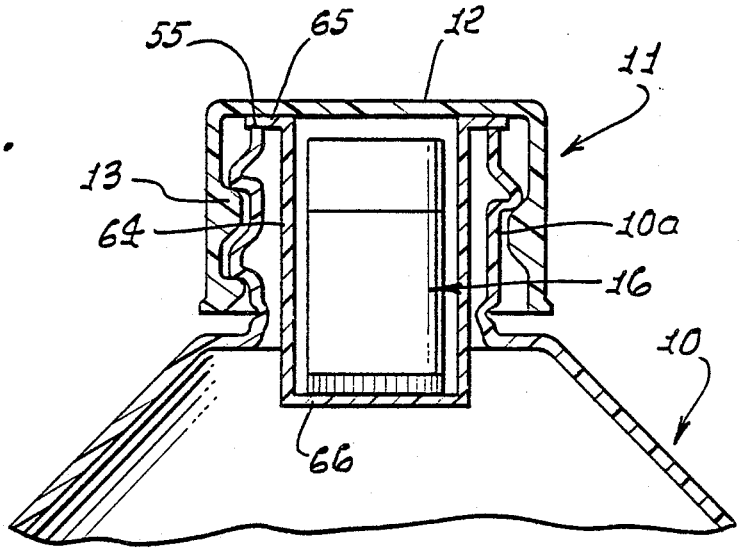
FIG. 8 is a section showing an inner activator container seated inside a flanged cup fitment which engages the top of the bottle finish.

In FIG. 8 a receptacle 64 has an external flange 65 seating on the bottle neck rim, and retained in position by the top wall 12 of the cap 11. The upwardly opening receptacle extends downwardly within the bottle neck 10*a*, and fitment 16 is loosely received in the receptacle, and confined between bottom wall 66 of the receptacle and top wall 12. Receptacle 64 is removable after cap 11 is removed.

Figure 7:
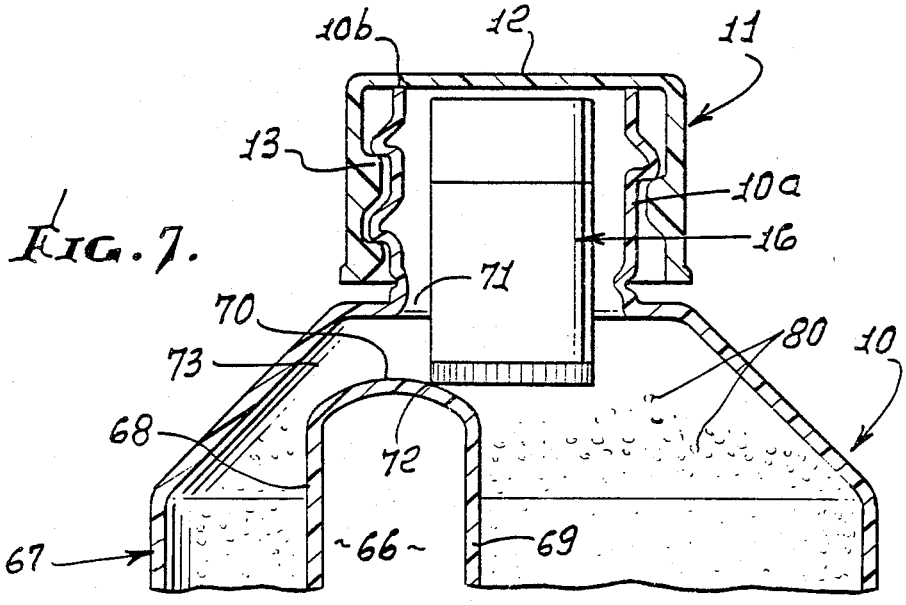
FIG. 7 is a section showing a fitment seated on a shelf formed in the bottle, as an indent or part of the bottle handle.
Figure 16:
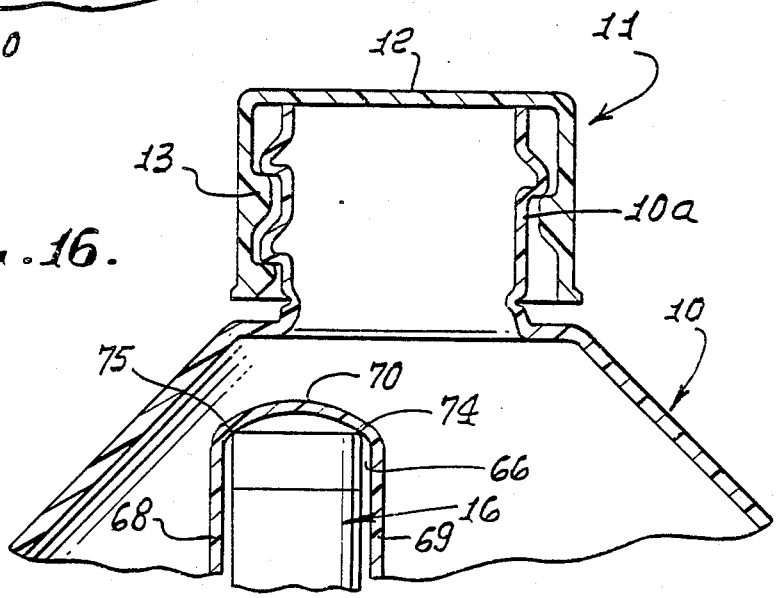
FIG. 16 is a section showing a fitment received within a recess formed in the bottle as an indent or handle.

In FIG. 7, the bottle 10 has side wall structure that forms a lateral hand reception opening 66 and a manually graspable handle 67 associated with that opening. The wall structure includes vertical walls 68 and 69, and wall upper portion 70 presented internally of the bottle and generally upwardly toward neck 10*a* and neck opening 71. The fitment 16 is seated at 72 on wall upper portion 70, within upper interior 73 of the bottle, and also extends upwardly into and within the neck opening 71, as shown. The fitment may be sufficiently large in diameter so as to be retained in position by the neck and by the wall portion 70. The opening 66 may be merely an indent, and other than associated with a handle. See also flowable bleach granules at 80, filling the bottle. In FIG. 16, the fitment 16 is received within the opening or indent 66, removably retained as by frictional engagement with the wall structure, as at points 74 and 75.

Figure 17:
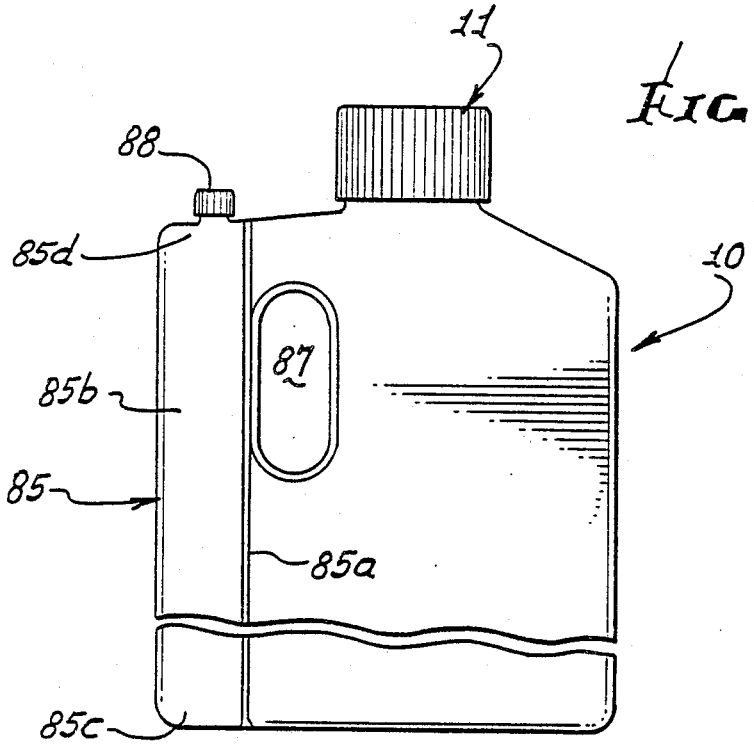
FIG. 17 is a vertical elevation showing a fitment molded as an integral part of a bottle, thereby forming a dual chambered container.

In FIG. 17, the fitment 85 extends externally of the bottle 10 and is attached thereto, as per example at the vertical location 85*a*, merging with the bottle side wall. Thus, the vertically elongated fitment may include a portion 85*b* forming a bottle handle associated with lateral opening 87 through the bottle for finger reception. The fitment is shown to extend upwardly from a location 85*c* near the bottom of the bottle to a location 85*d* near the top of the bottle. Fitment cap 88 is exposed externally of the bottle and its cap 11, and is offset laterally from cap 11, so that if cap 88 is removed, the flowable activator contents of the fitment container can be poured onto fabric to be washed, or into bleach granules to be added to the wash, and if cap 88 is replaced and cap 11 removed, bleach can be poured into the wash water.

Figure 18:
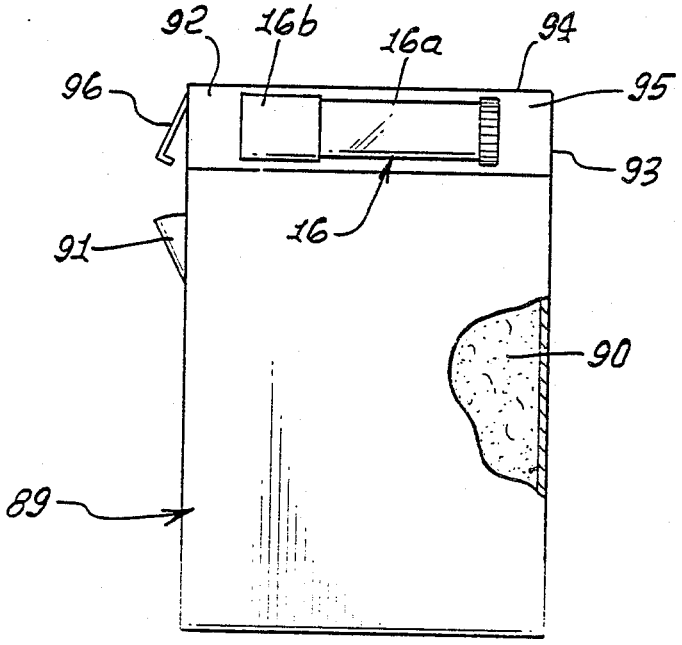
FIG. 18 is a vertical elevation, partly in section, showing a fitment contained in a separate compartment that is an integral part of a folding carton used to hold the dry bleach base.
Figure 19A:
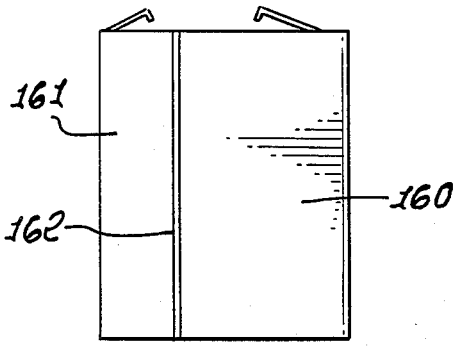
FIG. 19(*a*)–19(*d*) show alternative fitments associated with cartons.
Figure 19B:
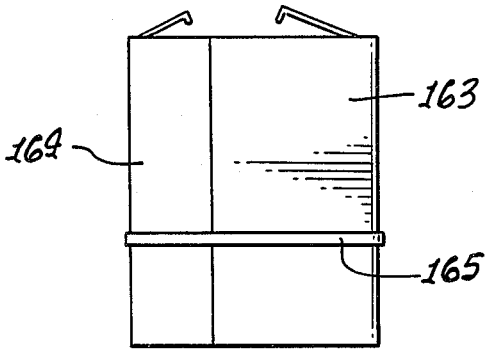
Figure 19C:
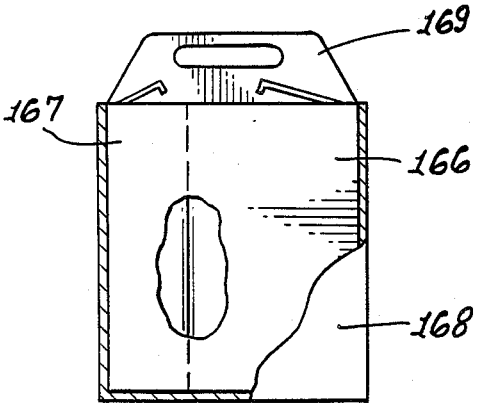
Figure 19D:
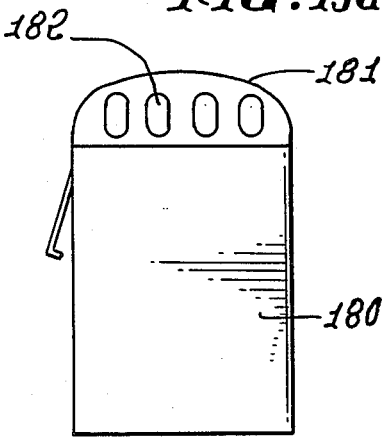

In FIG. 18, the carton 89 (as for example cardboard) contains detergent such as dry granules seen at 90. A pour spout appears at 91. The fitment 16 is carried in a separate compartment 92 defined by the carton, as for example by carton walls 93–95 at the top of the carton. A flap 96 is releasable to allow fitment removal.

Other possible ways of achieving the fitment using a carton are:

(1) Twin bleach and activator cartons as shown at 160 & 161 in FIG. 19(*a*) attached face-to-face, top-to-bottom, or side-to-side using glue, double-sided tape, or Velcro strip, indicated at 162;

(2) Twin bleach and activator cartons 163 & 164 banded together with tape, pressure sensitive sticker shrink wrap plastic, foil or paper overwrap, or a plastic sleeve, all of which are represented by band 165, in FIG. 19(*b*);

(3) Twin bleach and activator cartons 166 & 167 in an open-end paperboard sleeve, two pack carrier or tray, represented by carrier 168 with handle 169, in FIG. 19(*c*);

(4) A single carton containing two (bleach and activator) plastic bags, also as represented in FIG. 19(*c*);

(5) A single bleach carton 180 with a domed plastic overcap 181 containing the activator, such as tablets 182.

Other fitment designs are possible, and it is not intended that this invention be limited to the designs described in these figures.

BLEACH BASE COMPOSITION

Suitable compositions of the unactivated bleach base for this invention are well known in the industry, and can take conventional form, provided that the oxygen bleaching agent selected is capable of oxidizing halide ions to hypohalite and hypohalous acid. Of special interest in this regard is a triple salt of potassium peroxymonosulfate, potassium bisulfate, and potassium sulfate in the mole ratio of about 2:1:1, which is commercially available as Oxone, marketed by DuPont. Another bleaching agent, which has a sufficiently high oxidation potential for this application is magnesium monoperoxyphthalate, which is commercially available as H-48, marketed by Interox.

The base can be formulated to contain phosphate either as a sequestrant (e.g. sodium tripolyphosphate) or as a precipative builder (e.g. tetra sodium pyro phosphate). A particularly attractive variant, however, is to formulate the base without any inorganic phosphate enabling a single version of the product to be sold throughout the country, including areas which restrict or disallow the sale of laundry products containing phosphate. The selection of an appropriate builder system is of special importance in this application since the wash solution pH can dramatically affect the bleaching performance which results. Elevated pH's (e.g. in the range of 9.2.–10.2) enhance the performance of all oxygen bleaching agents; and also the detergency on many bleach resistant soils. Consequently, alkaline detergent/bleach combinations which are well buffered in this range are especially preferable when the unactivated bleach base is used. The activated version however, is even more effective at somewhat lower pH's (e.g. in the range of 8.5–9.5), due to the resulting increase in the ratio of hypohalous acid to hypohalite. It is therefore highly desirable to formulate the base to achieve a mid-range pH (e.g. about 9.2 to 9.5) in the wash water of a washing machine, providing effective bleaching performance both with and without activation. Another important variant is a weakly buffered base composition, coupled with the addition of a solid highly acidic substance in the activator (e.g. sodium bisulfate). It is necessary even in this approach, to include an alkalinity source since the peroxymonosulfate triple salt is itself acidic; and if used in conjunction with typical liquid laundry detergents which exhibit little buffering capacity, seriously reduce the detergency of the overall system. Depending on which of these goals is desired, appropriate builder compounds include pyrophosphates, tripolyphosphates, orthophosphates, carbonates, silicates, sesquicarbonate, bicarbonate, borates, zeolites, citrates, tartrate, gluconate, CMOS, EDTA, and NTA.

Including surfactants in dry bleach formulations is common especially given their increasingly important role as detergency boosters. Suitable surfactants for use in such a product include, but are not limited to linear alkylbenzene sulfonates, alkyl sulfates, alkyl ether sulfates, alpha olefin sulfonates, fatty acid soaps, ethoxylated nonyphenols, the ethoxylated long chain alcohols, and polyalkylene oxide block copolymers. These surfactants can be used, alone, in combination, or omitted entirely depending on the performance characteristics desired.

A number of other components are common in dry bleach formulations. Those which affect the performance characteristics include flourescent whitening agents, anti-redeposition agents (e.g. CMC), and enzymes (i.e. protease and/or amylease). Those affecting the aesthetic, physical stability, and processing characteristics include dyes, perfumes, anti-caking agents, fillers, and diluents.

EXAMPLES OF ACTIVATABLE FORMULATIONS:

| | I | II | III | IV | V | VI |
|---|---|---|---|---|---|---|
| Polyethoxylated nonylphenol | 10 | — | — | 5 | 5 | — |
| Sodium alkylbenzene sulfonate | 20 | 5 | 5 | — | — | 5 |
| Tetra sodium pyrophosphate | — | — | 10 | — | — | — |
| Sodium tripolyphosphate | — | — | 10 | — | — | — |
| Sodium carbonate | 20 | 45 | — | — | — | 45 |
| Sodium bicarbonate | — | — | — | 20 | 5 | — |
| Sodium borate | — | — | — | 10 | — | — |
| Sodium metasilicate (1:1) | — | — | 5 | — | 10 | — |
| Sodium silicate (1:2.4) | 10 | 10 | — | 10 | — | 10 |
| Oxone | 10 | 25 | 25 | 25 | 25 | — |
| Magnesium monoperoxyphthalate | — | — | — | — | — | 25 |
| Fluorescent whitener | 0.2 | 0.2 | 0.2 | 0.2 | 0.2 | 0.2 |
| Fumed silica | 0.2 | 0.2 | 0.2 | 0.2 | 0.2 | 0.2 |
| Perfume | 0.1 | 0.1 | 0.1 | 0.1 | 0.1 | 0.1 |
| Sodium sulfate | q.s. | q.s. | q.s. | q.s. | q.s. | q.s. |

These example formulations cover ranges of activatable dry detergent bleaches and dry bleaches as referenced in the previous discussion. The first example is a viable detergent which contains oxygen bleach as a relatively minor constituent. The second example is strongly buffered at a relatively high pH, while both the third and fourth examples are strongly buffered at a moderate pH. (The actual pH of the resulting wash solution depends upon the detergent selected.) The fourth example formulation has the added advantage of not containing any phosphate. The fifth example is weakly buffered and contains a relatively high alkalinity silicate (1:1 sodium oxide to silicate) to overcome Oxone's inherent acidity without contributing significantly to the system's buffering capacity. The sixth example contains magnesium monoperoxyphthalate as the oxygen bleaching agent.

The production of the bleach base can be accomplished in the conventional manner. Thus, it can be spray dried, with the oxygen bleaching agent subsequently admixed; alternatively, it can be either agglomerated, or simply dry mixed.

ACTIVATOR COMPOSITION

The activator portion of the product can contain any of the possible chloride and bromide salts. The potassium and sodium salts of each are of special interest, since they are readily soluble and do not contribute water hardness ions. The positive synergism between the chloride and bromide salts was demonstrated in a Tergotometer tea bleaching study at 90° F., using water of 150 ppm hardness, with a commercial household laundry detergent at the suggested level (0.15%), and Oxone at 20 ppm available oxygen. The scaled down equivalent of an eight gram sodium chloride tablet yielded 3% more soil removal; and the equivalent of a four gram sodium bromide tablet yielded 19% more soil removal. When both of these ingredients were added together (at the previous levels) however, the yield was 27% more soil removal, which is significantly greater than the sum of the two used alone. Other halide salts may be found to exhibit similar performance synergism, but the importance of this particular combination is reinforced by other considerations. The cost of sodium chloride is approximately one thirtieth that of sodium bromide. Also, although neither compound would be considered seriously toxic, they both have $LD_{50}$'s below 5 gram/kilogram. The toxicity of the mixed halides however, should be somewhat reduced, which is a highly desirable result when intended for household use.

The relative levels of bromide salt and chloride salt in the activator are affected by the amount of space available, the number of activations included per package, the magnitude of effect per use, and the amount(s) of minor ingredient(s) included. If this combination of factors does not restrict the space available for the activator, the preferred embodiment of this invention will include a high concentration of chloride salt relative to the bromide salt, thereby maximizing the synergistic advantage of the two in concert. In such a product, the weight of chloride salt may actually exceed the weight of bromide salt by as much as ten to one. If on the other hand, the amount of activator to be included is space limited then much smaller concentrations of chloride salt would be appropriate. In such an application, the chloride may actually be omitted entirely; forfeiting the positive synergism, lower cost, and any toxicity advantage.

Even extremely small amounts of sodium bromide alone have been shown to produce noticable activation under typical wash conditions (e.g. as little as one gram in a 16 gallon wash load with 20 ppm available oxygen at 90° F.). There are consequently many possible ways through which it can be introduced. Large tablets (i.e. 6–20 grams) would be suitable for use in a product positioned as a dual action bleach, which would be designed to either be activated or unactivated with no adjustability between the two extremes. Smaller tablets (of about four grams) could be provided with instructions to use several on durable fabric/dyes, which have severe staining; and fewer for less extreme applications. Further, granules could be provided either in a shaker or with a measuring cap, enabling the consumer to fine tune the activation. This would also speed dissolution by increasing the surface area to volume ratio. Another suitable vehicle for the halide salt activator would be an aqueous solution contained in a squeeze or dropper bottle, offering immediate dissolution.

Other useful components of the activator besides halide salts include solid acidic compounds (e.g. sodium bisulfate) to reduce the pH of the activated wash solution; and agents to speed dissolution such as starch which swells, fragmenting a tablet; or possibly a combination of citric acid and sodium bicarbonate, causing effervescence with similar results.

EXAMPLES OF ACTIVATOR FORMULATIONS:

| | I | II | III | IV | V |
|---|---|---|---|---|---|
| Sodium bromide | 20.0 | 40.0 | 60.0 | 75.0 | — |
| Potassium bromide | — | — | — | — | 95.0 |
| Sodium chloride | 75.0 | 10.0 | 35.0 | — | — |
| Citric Acid | — | — | 3.0 | — | — |
| Sodium bicarbonate | — | — | 2.0 | — | — |
| Starch | 5.0 | — | — | 5.0 | 5.0 |
| Sodium bisulfate | — | — | — | 20.0 | — |
| Water | — | 50.0 | — | — | — |

These example activator formulations were suggested in the previous discussion and are intended to cover a range of possibilities. The first example would be best suited for applications in which there is plenty of space available for the activator, and each successive example offers a higher bromide content and consequently more activation per unit weight (and per unit volume), but also much higher cost per unit weight. The second example is simply an aqueous solution of the halide salts, as discussed previously. The third example employs the citric acid/sodium bicarbonate effervescence for possible use in breaking apart a tablet; while the other three dry formulations include starch for that purpose. The fourth example contains sodium bisulfate for use with a weakly buffered bleach base to drop the pH of the activated system, thereby increasing the resulting activation.

Figure 20A:
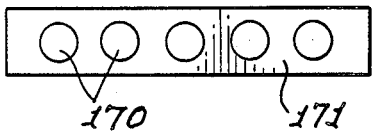
FIG. 20–20(*a*) show activator tablets and granules packaged for carriage by bleach containers.

There are a number of additional or variant ways in which the activator can be included in the product, and yet physically isolated from the bleach base, including:

(1) A dial type tablet dispenser molded into the top of the overcap, as in FIG. 14 but with tablets at 17;

(2) Tablets in a strip pack, (see FIG. 20*a*, with tablets 170 removable from strip 171, to be coiled and received in bottle cap)

Figure 20:
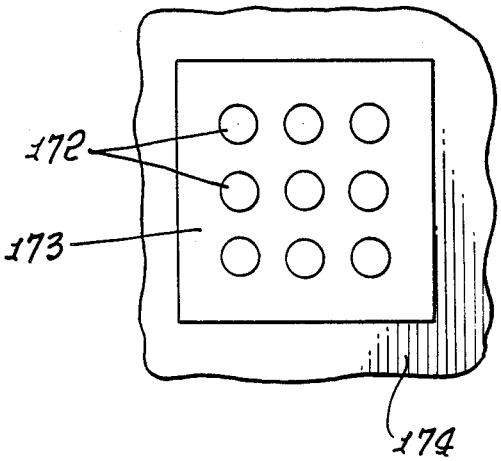
Figure 20:
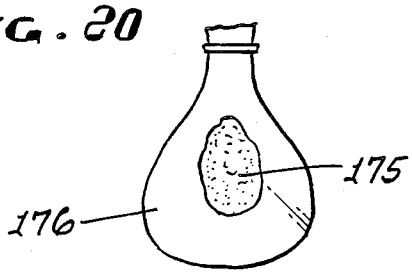

(3) Tablets in a punch-out card, (see FIG. 20(*b*) showing tablets 172 removable from card 173 carried by and removable from bleach carton 174), (4) Water soluble pouches of loose granules, (see FIG. 20(*c*) showing granules 175 within pouch 176 insertible within a dry bleach bottle or carton)

(5) Halide granules in vial, with cap for measuring (see FIGS. 5 & 6)

(6) Halide solution in vial, with cap for measuring (see FIGS. 5 & 6)

Both the bleach base container and the activator container can be made from any suitable material including polyethylene, polypropylene, polyvinyl chloride and other plastic, glass, metal, or paperboard. In the case of paperboard, a suitable moisture barrier would be advantageous to maintain good flow characteristics after prolonged storage in humid environments.

The activator packaged in tablet form may comprise a dispenser hung on a bleach bottle neck, or attached to the exterior of a bleach carton (as fo example as described above), or enclosed in a carton and supported on the dry bleach therein.

In the above description of bleach bottle and activator fitment examples, the bottle cap may define a first predetermined bleach fill volume, and the fitment sub-container cap may define a second predetermined activator fill volume. Such fill volumes may then define a measuring system characterized in that the amount of activator (filled into the sub-container cap) to be mixed with a selected amount of bleach (filled into the bottle cap) for most effective activation of the bleach in the wash water is determined by a predetermined established ratio of the two fill volumes. In this regard, the bleach activator composition may have one of the following forms: tablets, granules, water soluble packets, and solution.

It will also be understood that the bottle, as at 10 and/or 10*a* may have a transparent (glass, plastic, etc.) side wall for viewing of the bottle contents, and that the fitment dispensing container (as for example at 16) may extend within the bottle to an extent such that the dispensing container can be seen sidewardly through the bottle side wall. In this regard, the dispensing container may also have a transparent side wall (16*a*, for example) whereby the composition in the dispensing container 16 can also be seen through both such transparent side walls.

We claim:

1. A laundry aid package comprising, in combination:

(a) a first openable container containing a bleach base that includes an oxygen bleaching agent for use in home laundering of fabrics, (b) a dispensing container containing a bleach activator composition and forming a fitment, the activator composition including a halide salt or salts selected from the group consisting of chloride salts and bromide salts of an alkali metal or metals, (c) the fitment carried by the first container to be readily detachable at least in part for dispensing the activator composition to controllably activate the bleach at the time of fabric laundering, (d) the first container being a bottle having a removable cap, the bottle having a neck onto which the cap is attached, (e) the fitment including a receptable associated with the cap and received into said neck and having a flange supported by an upper rim of said neck, the cap retaining the receptacle in position in said neck, (f) the fitment receptacle defining a sub-container containing the activator composition, and a removable sub-container cap, for providing access to the activator composition after removal of the sub-container cap, (g) the fitment being accessible after removal of the cap from the bottle, and the bleach base composition in the bottle being accessible after removal of said receptacle from the bottle neck as by elevation of said flange, (h) all of the activator, and all of the halide salt in the package being confined within said receptacle, whereby the bleach base is free of halide salt admixed therewith, (i) substantially the entirety of the receptacle as well as the activator and halide salt therein being protectively confined within said neck, and spaced inwardly therefrom, with the activator entirely out of direct communication with the bleach base in the first container whereby the bleach base cannot be activated by contact with any halide salt until the halide salt in the receptacle is accessed and dispensed at the time of fabric laundering, (j) the entirety of the bottle cap and fitment receptacle being a one-piece unit, (k) the bleach base containing an oxygen bleaching agent and the activator consisting essentially of one of the following compositions I, II, III, IV and V, wherein ingredient weight percentages are about the same as those listed:

| | I | II | III | IV | V |
|---|---|---|---|---|---|
| Sodium bromide | 20.0 | 40.0 | 60.0 | 75.0 | — |
| Potassium bromide | — | — | — | — | 95.0 |
| Sodium chloride | 75.0 | 10.0 | 35.0 | — | — |
| Citric Acid | — | — | 3.0 | — | — |
| Sodium bicarbonate | — | — | 2.0 | — | — |
| Starch | 5.0 | — | — | 5.0 | 5.0 |
| Sodium bisulfate | — | — | — | 20.0 | — |
| Water | — | 50.0 | — | — | — |

2. The combination of claim 1 wherein the bottle cap has a internal thread.

3. The combination of claim 2 wherein the cap has a depending skirt that extends in interfitting relation with said neck.

4. The combination of claim 3 wherein the fitment includes a sub-container integral with the bottle cap and extending thereabove, and sub-container cap structure connected to the fitment sub-container.

5. The combination of claim 1 wherein the sub-container side wall is integrally molded with said bottle cap top wall.

6. The combination of claim 5 wherein the fitment sub-container cap is presented at the exterior side of the bottle cap top wall.

7. The combination of claim 1 wherein the bleach base consists essentially of one of the following compositions I, II, III, IV, V and VI wherein ingredient weight percentages are about the same as those listed:

| | I | II | III | IV | V | VI |
|---|---|---|---|---|---|---|
| Polyethoxylated nonylphenol | 10 | — | — | 5 | 5 | — |
| Sodium alkylbenzene sulfonate | 20 | 5 | 5 | — | — | 5 |
| Tetra sodium pyrophosphate | — | — | 10 | — | — | — |
| Sodium tripolyphosphate | — | — | 10 | — | — | — |
| Sodium carbonate | 20 | 45 | — | — | — | 45 |
| Sodium bicarbonate | — | — | — | 20 | 5 | — |
| Sodium borate | — | — | — | 10 | — | — |
| Sodium metasilicate (1:1) | — | — | 5 | — | 10 | — |
| Sodium silicate (1:2.4) | 10 | 10 | — | 10 | — | 10 |
| Oxone | 10 | 25 | 25 | 25 | 25 | — |
| Magnesium monoperoxyphthalate | — | — | — | — | — | 25 |
| Fluorescent whitener | 0.2 | 0.2 | 0.2 | 0.2 | 0.2 | 0.2 |
| Fumed silica | 0.2 | 0.2 | 0.2 | 0.2 | 0.2 | 0.2 |
| Perfume | 0.1 | 0.1 | 0.1 | 0.1 | 0.1 | 0.1 |
| Sodium sulfate | q.s. | q.s. | q.s | q.s. | q.s. | q.s. |

and the activator includes a halide salt or salts selected from the group consisting of chloride salts and bromide salts of an alkali metal or metals.

8. The combination of claim 1 wherein the bleaching agent is capable of oxidizing halide ions to hypohalite and hypohalous acid, and is selected from the group consisting of (i) a triple salt of potassium peroxymonosulphate, potassium bisulfate and potassium sulfate, (ii) magnesium monoperoxyphthalate.

9. The combination of claim 8 wherein the bleach base includes at least one of the following:

($x_1$) sodium tripolyphosphate ($x_2$) tetra sodium pyro phosphate ($x_3$) builder salt selected from the group consisting of pyrophosphate, tripolyphosphate, orthophosphate, carbonate, silicate, sesquicarbonate, bicarbonate, borate, zeolite, citrate, tartrate, gluconate, CMOS, EDTA and NTA ($x_4$) surfactant ($x_5$) fluorescent whitening agent ($x_6$) anti-redeposition agent ($x_7$) enzyme ($x_8$) dye ($x_9$) perfume ($x_{10}$) anti-caking agent ($x_{11}$) filler ($x_{12}$) diluent.

10. The combination of claim 1 wherein the bleach activator composition has one of the following forms:

(i) granular (ii) tablets (iii) water soluble packet (iv) solution.

11. The combination of claim 1 wherein the bottle cap defines a first predetermined bleach fill volume within a zone occupied in part by the fitment sub-container, and the fitment sub-container cap defines a second predetermined activator fill volume, said fill volumes defining a measuring system characterized in that the amount of activator to be mixed with a selected amount of bleach is determined by a predetermined established ratio of said fill volumes.

12. The combination of claim 1 wherein the activator comprises tablets supported by one of the following:

(a) strip (b) card.

13. The combination of claim 1 wherein the dispensing container comprises a pouch containing activator granules.

14. The combination of claim 1 wherein the bottle has a transparent side wall whereby the dispensing container and the bleach base can be seen sidewardly through the bottle transparent side wall.

15. The combination of claim 14 wherein the dispensing container also has a transparent side wall, whereby the bleach activator can also be seen through both said bottle and said dispensing container transparent side walls.

16. The combination of claim 1 wherein the first container side wall is transparent, whereby the fitment may be observed in said recess, from the exterior.

17. The combination of claim 1 wherein the fitment extends externally of the bottle and is attached thereto, the fitment including a detachable cap exposed exteriorly of the bottle and bottle cap.

* * * * *